United States Patent [19]

Page

[11] 4,424,794

[45] Jan. 10, 1984

[54] FIREPLACE ADAPTER

[75] Inventor: Charles Page, Randolph, Vt.

[73] Assignee: Vermont Castings, Inc., Randolph, Vt.

[21] Appl. No.: 253,399

[22] Filed: Apr. 13, 1981

[51] Int. Cl.[3] ..... F24B 7/00

[52] U.S. Cl. ..... 126/123; 126/137; 126/120; 126/318

[58] Field of Search ..... 126/123, 120, 126, 85 B, 126/94, 82, 301, 307 R, 319, 315, 280; 98/58, 60; 138/120; 248/354 S

[56] References Cited

U.S. PATENT DOCUMENTS

| | | | |
|---|---|---|---|
| 1,583,080 | 5/1926 | McCallum | 126/126 |
| 2,791,213 | 5/1957 | Goulding, Sr. | 126/123 |
| 4,026,264 | 5/1977 | Henriques | 126/120 X |
| 4,306,491 | 12/1981 | Reardon, Jr. | 126/280 X |
| 4,329,973 | 5/1982 | Scullin, Jr. | 126/123 |

FOREIGN PATENT DOCUMENTS

| | | | |
|---|---|---|---|
| 23285 | 12/1882 | Fed. Rep. of Germany | 126/120 |
| 1751035 | 8/1970 | Fed. Rep. of Germany | 126/315 |
| 756025 | 8/1956 | United Kingdom | 126/120 |
| 797229 | 6/1958 | United Kingdom | 126/82 |

OTHER PUBLICATIONS

*Mohawk Damper Panel,* Temp Wood, Mohawk Industries.

*Simplifire Adaptor,* Kent Products, Inc., P.O. Box 281, Kent, Connecticut.

*Garrison Fireplace Adaptor,* Garrison Stove Works, Box 412, Claremont, New Hampshire.

*Fireplace Installations,* Bulletin No. 10, Sep. 10, 1979, Vermont Castings, Inc., Randolph, Vt.

*Primary Examiner*—James C. Yeung

*Assistant Examiner*—Randall L. Green

*Attorney, Agent, or Firm*—Kenway & Jenney

[57] ABSTRACT

A method and apparatus for guiding gaseous effluents from the exit aperture of a gas producing device to a fireplace exit flue adapts to a large range of damper opening angles and sizes. The apparatus includes a damper closure plate for closing down the damper opening of the fireplace. The damper plate has an opening therein for receiving a connection assembly which connects at one end to the exit aperture of the gas producing device and at the other end passes through the damper closure plate and is secured thereto. The connection assembly, at the end passing through the damper closure plate, has a curved elongated section which can pivot at the damper plate opening to enable adjustment to the large range of opening orientations. The fireplace adapted is particularly useful in connection with wood and coal burning stoves having an airtight configuration.

6 Claims, 8 Drawing Figures

FIREPLACE ADAPTER

The invention relates generally to heat producing apparatus and methods and in particular, to a method and apparatus for connecting a gas producing heating device to a fireplace exit flue.

The use of wood and coal burning parlor stoves has become increasingly prevalent as the cost of oil and gas fuels increases. Generally, wood burning and coal burning parlor stoves are freestanding devices, typically with a cast iron or porcelain covered frame, for providing heat radiation and convection in all directions. In addition, it is not uncommon to install a parlor stove in or near a fireplace and to employ the fireplace flue as the exit flue for the stove. In this circumstance, a fireplace insert is often provided which covers the opening from the room into the fireplace and a flue connection is made from the parlor stove or other heating apparatus to the fireplace exit flue through the damper opening.

The installation of a parlor stove in a fireplace insert configuration requires that the flue gas outlet of the stove be substantially sealingly connected to the fireplace flue. In this manner, the gaseous combustion products are safely directed to the fireplace flue and thence to the outside environment.

In most circumstances in which a heating apparatus is connected so that its combustion products exit through the fireplace flue, a separate, substantially one of a kind, connection must be made. These connections prove particularly "unique" because the angle of the damper opening, relative to a horizontal datum plane, can vary from fireplace to fireplace. Therefore, to provide a sealing engagement, a special connection must be implemented. That connection must take into account the many damper opening angles which are possible or otherwise seal the firebox of the fireplace from the room beyond.

An object of the invention, therefore, is a method of and apparatus for providing a universal connection from a heating apparatus to a fireplace exit flue. Other objects of the invention are a method and apparatus for guiding gaseous effluents from the exit aperture of a gas producing heating apparatus to a fireplace exit flue which is simple to install, reliable, low in cost, safe, and flexible in use.

SUMMARY OF THE INVENTION

The invention relates to an apparatus for guiding gaseous effluents from the exit aperture of a gas producing device to a fireplace exit flue. In one aspect, the invention features a damper closure plate for closing off a damper opening of the fireplace and having an opening therein, and a connection assembly connected at one end to the exit aperture of the heating apparatus and at its second end to the damper closure plate. The connection assembly has at its second end a curved elongated section, which in one particular embodiment is of substantially constant cross-sectional area. The connection assembly at its second end is adapted to pass through the opening of the closure plate and to pivot therein at its curved section.

In one particular embodiment of the apparatus of the invention, the connection assembly features a T-shaped section for connecting to the gas producing device. The T-shaped section has at a first section a closed end for collecting solid particulate. The curved elongated section guides gases from the T-shaped section to the fireplace exit flue.

In another aspect, the invention relates to a method for guiding gaseous effluents from the exit aperture of a gas producing apparatus to the fireplace exit flue. The method features the steps of reducing the dimensional size of the damper opening in a fireplace to form an artificial aperture, passing a connection assembly through the artifical aperture, pivoting the connection assembly in the aperture to position the connection assembly relative to the heating apparatus, and sealingly engaging the connection assembly at the aperture, thereby providing a sealing engagement along a path from the gas producing apparatus to the exit flue.

DESCRIPTION OF THE DRAWINGS

Other objects, features, and advantages of the invention will appear from the following description of particular embodiments of the invention taken together with the drawings in which.

DESCRIPTION OF A PREFERRED EMBODIMENT

Figure 1:
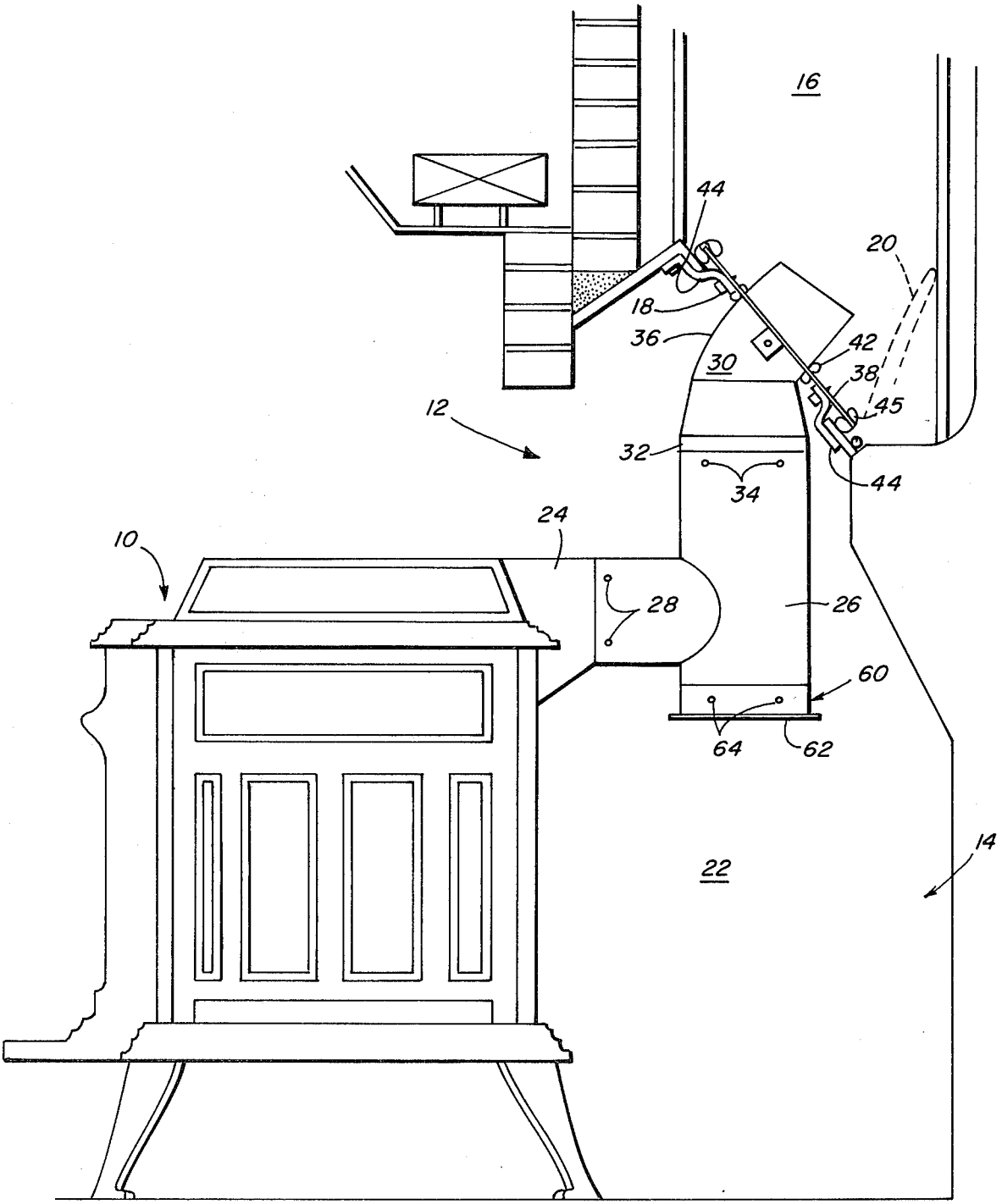
FIG. 1 is a side elevation view of a typical heat producing apparatus installed in a fireplace according to a first particular embodiment of the invention.
Figure 8:
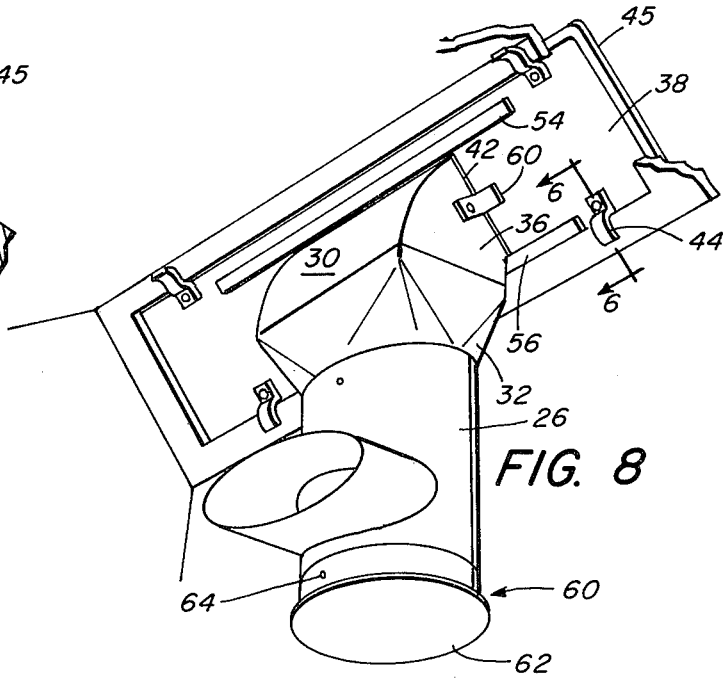
FIG. 8 is a perspective view of an adapter, according to the invention.

Referring to FIGS. 1 and 8, a heating apparatus 10 for example a wood or coal burning stove is inserted into a fireplace opening 12 of a fireplace 14. The fireplace has a flue gas exit path 16 which extends vertically upward from a damper opening 18 which is normally closed by a damper element 20 when the fireplace is not in use. When the fireplace is being used, the damper 20 is pivoted away from the opening 18 as shown in FIG. 1. The heating apparatus 10 extends, in the illustrated embodiment, just slightly into firebox 22 of fireplace 14. The heating apparatus has a flue gas exit aperture, at an upper portion thereof in the illustrated embodiment, through which the gaseous waste products of combustion pass. In the illustrated embodiment of the invention, a flue collar 24 is attached to the heating apparatus and provides the exit aperture through which the gaseous products exit the apparatus.

Figure 6:
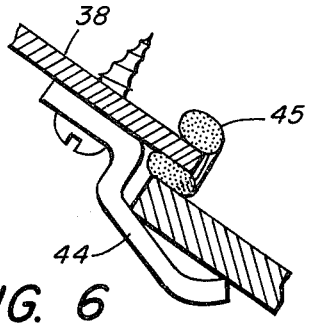
FIG. 6 is a cross-sectional view along lines 6—6 of FIG. 8.

According to the illustrated embodiment of the invention, a T-shaped section 26 is attached to the flue collar 24, for example by screws 28, and gaseous products passing therethrough are directed up the "T" to a curved section 30 which guides the gases to and through the damper opening. The section 30 has a first portion 32 which is connected to T-shaped section 26 for example by screws 34 and a second section 36 which extends through a damper closure plate 38 into the exit flue. In the illustrated embodiment, section 36 has a preferably rectangular cross section normal to the direction of gas flow and is adapted to pass through damper closure plate 38, which is secured across the damper opening, at an aperture 40 therein. Aperture 40 has a cross-sectional area just slightly larger than that of the exterior of upper section 36 and is provided with a gasket member 42 to provide sealing engagement with upper section 36. The damper closure plate is secured in position across the damper opening by clip or tab members 44 connected thereto. These members are attached so as to secure the damper plate at the damper opening (See FIG. 6). A second gasket seal 45 is provided around the outside edge of damper closure plate 38 to complete the air tight configuration and to prevent gases from passing around the closure plate.

Figure 2:
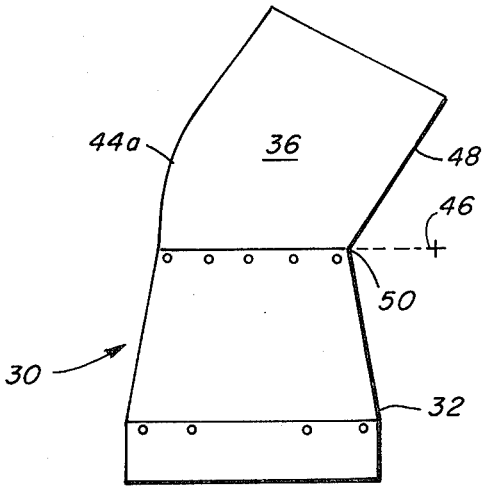
FIG. 2 is an elevation view of the upper section of the embodiment of FIG. 1.
Figure 7:
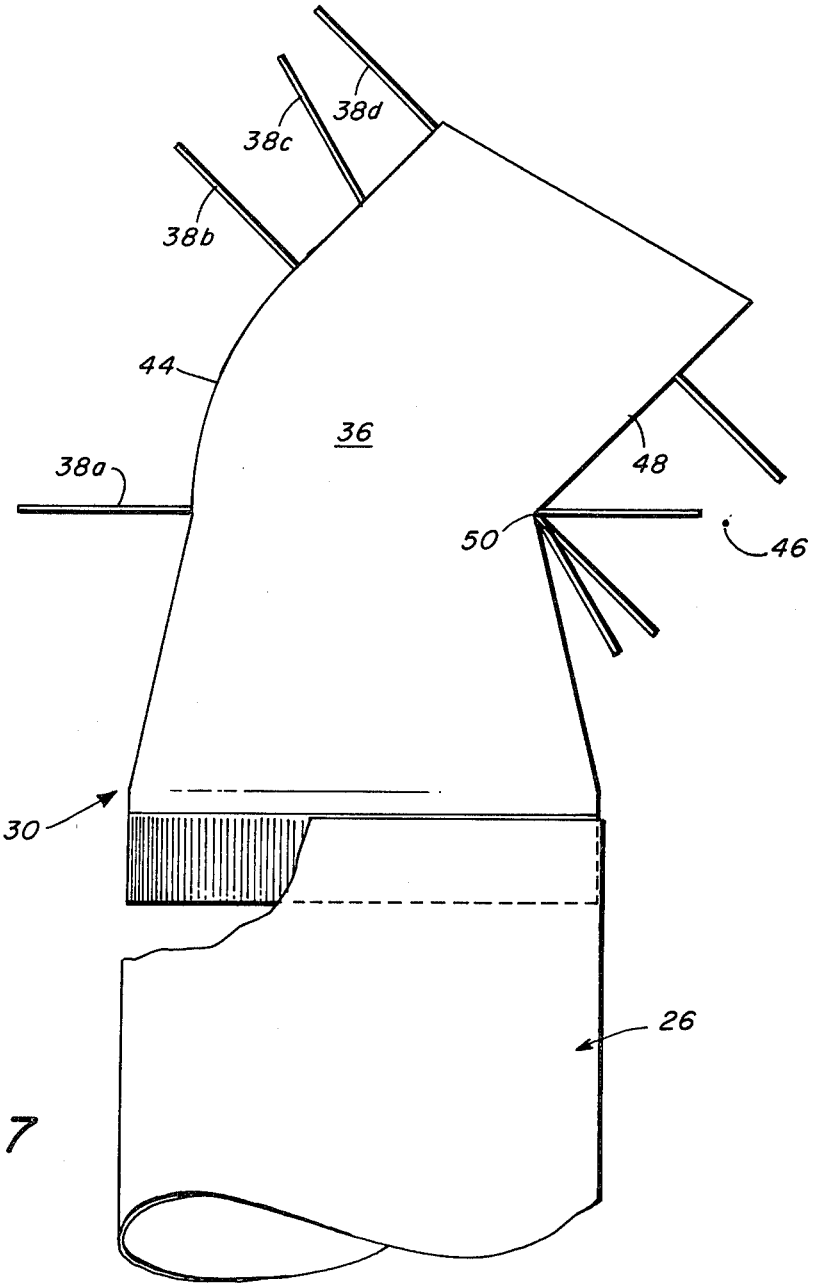
FIG. 7 is a schematic diagram illustrating different positions of the damper closure plate relative to the connection assembly.

Referring to FIG. 2, the upper section 36 of upper guide element 30 has, at section 36, a curved elongated axial shape. The illustrated configuration of FIG. 2 is flat on three sides and has a curved side 44*a* which is preferably radiused from a center of radius 46. The section 36 of FIG. 2 can pivot in aperture 40 of damper closure plate 38 along a flat side 48. In particular, it is preferable to pivot this section around a pivot axis 50. In addition to being pivotable around what is substantially an edge of the aperture 40 of plate 38, the elongated section 36 can slide, in the general direction of gas flow (along side 48), into and out of opening 40 in order to accommodate different heights and locations of heating apparatus exit apertures. In this manner, the element 30 can be fit through the aperture of the damper closure plate and can be adjusted to fit substantially any practical orientation of damper opening relative to a horizontal datum plane. Referring to FIG. 7, typical positions of the damper closure plate are illustrated at 38*a*, 38*b*, 38*c*, 38*d*. Thereby, the gaseous effluents from the heating apparatus pass through the assembly of T-shaped section 26 and element 30 into the exit flue of the fireplace.

Figure 5:
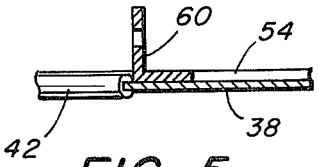
FIG. 5 is a cross-sectional view along lines 5—5 of FIG. 3.
Figure 3:
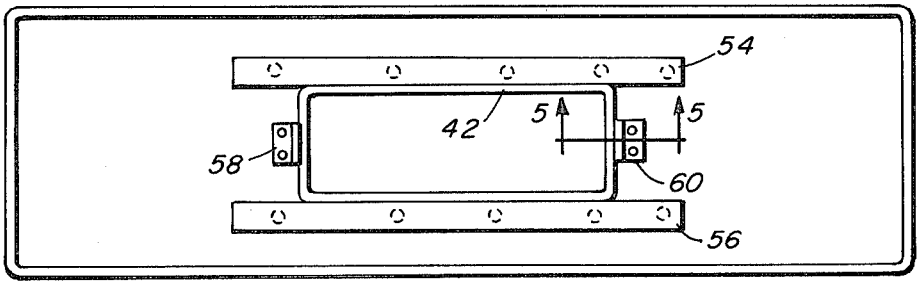
FIG. 3 is a plan view of a damper closure plate according to the invention.

Referring now to FIG. 3, the damper closure plate is preferably constructed of twenty-four gauge sheet steel having reinforcing straps 54 and 56 spot welded thereto. The reinforcing straps can be for example one-eighth or one-sixteenth inch thick cast iron. The opening of the damper plate accepts the gasketing material 42 which provides, in combination with section 36 of element 30, a first sealing relationship required for safe and reliable operation of the heating apparatus. The damper closure plate further has tab elements 58 and 60 secured thereto, for example by spot welding, a screw connection secures the section 36 to the damper closure plate (See also FIG. 5).

Referring now to FIG. 1, the T-shaped section has a closed bottom portion 60 which enables the collection and eventual removal of solid particulate which may be in the exit products of combustion. The closure 60 is preferably effected by a closure member 62 connected, for example by screws 64, to the otherwise open bottom of T-section 26.

Figure 4:
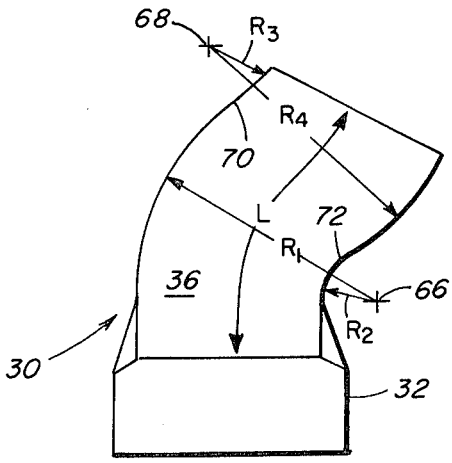
FIG. 4 is an elevation view of a second particular configuration of the upper section according to the invention.

Referring now to FIG. 4, the upper guide element 30, in a second particular embodiment of the invention, has its curved elongated axial shape constructed, as shown in this illustrated embodiment, from the merging of two radiused portions. Preferably, the width of the curved shape, as measured through a center of radius such as centers 66 or 68, is constant throughout the elongated length L. As shown in FIG. 4, in the illustrated embodiment, the radii are selected so that radii R1 and R3 describe circles which are tangent to each other (at 70) and radii R2 and R4 describe circles which are tangent to each other, for example at 72. In this manner, the element 30 can be fit through the aperture of the damper closure plate and adjusted to fit substantially any orientation of the damper opening, so that the gaseous effluents from the heating apparatus pass across the plane of the damper opening in a direction substantially normal thereto.

The described connection from heating apparatus 10 to exit flue 16 of fireplace 14 provides a flexible and reliable apparatus and method for directing the gaseous products of combustion safely into the environment, for example outside the home. The curved section 36 advantageously enables a single structural construction to "fit" a variety of damper angles. This is important because fireplaces, being a "non-standard" item, have dampers which can be at any of a large range of angles (for example from 25° to 60°) relative to the horizontal datum plane. Further, the relatively narrow rectangular cross section of section 36 provides a reliable and stable connection even in "narrow" confined damper opening configurations.

Additions, subtractions, deletions, and other modifications of the disclosed preferred embodiment of the invention will be obvious to those skilled in the art. Thus, for example, various changes of shape or cross-sectional area will be obvious to those practiced in the art and are within the scope of the following claims.

What is claimed is:

1. A universal fireplace flue adapter assembly for sealably connecting the flue outlet of a heating device to the fireplace chimney flue through a fireplace throat having an existing damper assembly including a damper frame with an opening, the plane of the opening making a given angle with the horizontal up to a maximum angle, and a movable damper element normally adaptable to open or close the opening to the chimney flue, movable to a position out of the way of the opening, comprising an adapter plate having an opening smaller than the damper frame opening, means for sealably securing said adapter plate parallel to and in juxtaposition with the damper frame so that the adapter plate opening is encompassed by and substantially coplanar with the damper frame opening, a curved duct extending through the adapter opening, said curved duct having a lower inlet end below the adapter plate and an upper outlet end extending upwards behind the adapter plate, the angle between the direction of the inlet and outlet ends corresponding to the maximum angle, said curved duct further including a curved transition section between said inlet and outlet ends with a geometry such that the outer surface of said curved duct which intersects said adapter plate opening is substantially congruent to the inner periphery of the opening for any angle made by said existing damper frame, said curved transition section being a hollow section formed by front and back walls and a pair of sidewalls, at least the front wall being curved for allowing angular movement such that when the duct is tilted on the line where the back wall meets the back edge of the opening, the cross section of the curved duct intersected by the plane of the adapter opening continuously matches that of the adapter opening, and means for securing said curved duct in said adapter plate so that the lower inlet end is substantially vertical regardless of the damper frame angle.

2. The assembly of claim 1, wherein said adapter plate opening is substantially rectangular.

3. The assembly of claim 2, wherein the sidewalls of the transition section of the curved duct are flat and parallel.

4. The assembly of claim 3, wherein the back wall of the transition section of the curved duct is flat.

5. The assembly of claim 1, wherein the front wall of the transition section of the curved duct is cylindrical.

6. The assembly of claim 5, wherein the axis of the cylindrical front wall of the transition section of the curved duct lies in the same plane as the back wall.

* * * * *